US008663443B2

(12) United States Patent
Schoenherr et al.

(10) Patent No.: US 8,663,443 B2
(45) Date of Patent: Mar. 4, 2014

(54) ZIRCONIUM PHOSPHATING OF METAL COMPONENTS, IN PARTICULAR IRON

(76) Inventors: Maximilian Schoenherr, Regensburg (DE); Jerzy-Tadeusz Wawrzyniak, Duesseldorf (DE); Eva Wiedemann, Krefeld (DE)

( * ) Notice: Subject to any disclaimer, the term of this patent is extended or adjusted under 35 U.S.C. 154(b) by 248 days.

(21) Appl. No.: 12/785,120

(22) Filed: May 21, 2010

(65) Prior Publication Data

US 2010/0293788 A1 Nov. 25, 2010

Related U.S. Application Data

(63) Continuation of application No. PCT/EP2008/066144, filed on Nov. 25, 2008.

(30) Foreign Application Priority Data

Nov. 26, 2007 (DE) ..... 10 2007 057 185

(51) Int. Cl.
*C25D 13/12* (2006.01)
*C23C 22/36* (2006.01)

(52) U.S. Cl.
USPC ..... 204/486; 204/510; 148/247

(58) Field of Classification Search
USPC ..... 204/486, 510; 148/247
See application file for complete search history.

(56) References Cited

U.S. PATENT DOCUMENTS

| | | | | |
|---|---|---|---|---|
| 4,017,335 | A | 4/1977 | Maloney | |
| 5,143,562 | A * | 9/1992 | Boulos | 148/247 |
| 5,356,490 | A | 10/1994 | Dolan et al. | |
| 6,758,916 | B1 * | 7/2004 | McCormick | 148/251 |
| 6,869,513 | B2 * | 3/2005 | Kulfan et al. | 204/488 |
| 7,063,735 | B2 * | 6/2006 | Fristad et al. | 106/14.44 |
| 2007/0068602 | A1 | 3/2007 | Pemberton | |

FOREIGN PATENT DOCUMENTS

| | | | |
|---|---|---|---|
| DE | 1933013 | A1 | 1/1971 |
| DE | 2715292 | C2 | 12/1987 |
| DE | 19933189 | A1 | 1/2001 |
| DE | 10005113 | A1 | 8/2001 |
| DE | 1020005059314 | A1 | 6/2007 |
| JP | 59083775 | A | 5/1984 |
| WO | 03002781 | A1 | 1/2003 |
| WO | 03100130 | A2 | 12/2003 |
| WO | 2004063414 | A2 | 7/2004 |

OTHER PUBLICATIONS

International Search Report, International application PCT/EP2008/066144 dated Feb. 17, 2009.

* cited by examiner

*Primary Examiner* — Kishor Mayekar
(74) *Attorney, Agent, or Firm* — Mary K. Cameron

(57) ABSTRACT

The present invention relates to a method for the corrosion-protective pretreatment of metal components, which at least partially comprise metal surfaces made of iron, using a chromium-free aqueous treatment solution, which contains fluoro-complexes of zirconium and/or titanium and phosphate ions in a specific ratio range to one another, and a metal component which is pretreated accordingly, and the use thereof for the application of further corrosion-protective coatings and/or lacquer systems. The method is suitable in particular as a pretreatment for electrophoretic painting of metal components, which are provided in the form of non-closed hollow bodies.

19 Claims, 2 Drawing Sheets

ZIRCONIUM PHOSPHATING OF METAL COMPONENTS, IN PARTICULAR IRON

CROSS-REFERENCE TO RELATED APPLICATIONS

This application is a continuation under 35 U.S.C. Sections 365(c) and 120 of International Application No. PCT/EP2008/066144, filed Nov. 25, 2008 and published on Jun. 4, 2009 as WO 2009/068523, which claims priority from German Patent Application Serial No. 10 2007 057 185.4 filed Nov. 26, 2007, which are incorporated herein by reference in their entirety.

BACKGROUND OF THE INVENTION

The present invention relates to a method for the corrosion-protective pretreatment of metal components, which at least partially comprise metal surfaces made of iron, using a chromium-free aqueous treatment solution which contains fluoro complexes of zirconium and/or titanium and phosphate ions in a specific ratio range to one another, and a metal component which is pretreated accordingly, and the use thereof for the application of further corrosion-protective coatings and/or lacquer systems. The method is suitable in particular as a pretreatment for electrophoretic painting of metal components, which are present in the form of non-closed hollow bodies. The present invention therefore also provides a method for coating a non-closed metal hollow body which encompasses both the pretreatment using the chromium-free aqueous treatment solution and also subsequent electrophoretic painting, and a metal hollow body which is coated in accordance with the method according to the invention, and the use thereof for the production of radiators.

The passivation of metallic materials, particularly of iron and ferrous steels, is primarily ensured by zinc or iron phosphating. In zinc or iron phosphating, mainly crystalline inorganic coatings are produced on the metal base material, which have a layer thickness of several micrometers and, owing to their surface topography, possess excellent adhesion to organic top coats, especially to lacquer systems applied by an electrophoretic method. In non-film-forming iron phosphating, the conversion of the metal surface is typically carried out in a phosphoric acid medium, and also in the presence of accelerators and wetting agents at an elevated bath temperature. These iron phosphate films seldom have coating weights of more than 1 g/m$^2$ and, in contrast to phosphating with high coating weights, they are amorphous. Classic phosphating usually constitutes a multi-step method consisting of a cleaning step for degreasing the component, an activation process and finally the actual phosphating, with rinse steps being incorporated into the continuous operation to decouple the process baths. A rinse operation of this type is compulsory at least after the cleaning step, so the phosphating is composed of at least four individual processes which have to be monitored and controlled from a process engineering viewpoint in individual baths. These high process engineering requirements and the associated complexity of a phosphating operation sometimes represent an obstacle to the introduction of a passivation of this type for components in low-cost applications outside of car manufacturing. Another technical disadvantage is the processing of residues such as phosphate sludge contaminated with heavy metals, which are unavoidable with the high phosphate contents in the passivating dipping bath and can only be processed with further energy and matter conversion. Overall, therefore, not least the elevated bath temperatures make classical phosphating a method having high energy costs and a huge requirement for recovery measures.

Besides non-film-forming iron phosphating, additional alternative methods to standard phosphating, which yields coating weights of significantly more than 1 g/m$^2$, are conversion treatments of the metal surfaces, forming purely amorphous, inorganic passive layers with much lower coating weights of the order of magnitude of less than 200 mg/m$^2$ in some cases.

All pretreatment methods which bring about such a "non-film-forming" (non-crystalline) phosphating and/or conversion of the metal surface have the advantage that activation of the surface becomes superfluous and thus can be cut from the pretreatment process chain. Another advantage over film-forming zinc phosphating is the reduction of phosphate sludge in the phosphating baths.

For example, U.S. Pat. No. 5,356,490 and WO 04/063414 teach phosphate-free and chromium-free aqueous treatment solutions containing zirconium and/or titanium compounds which are deposited on the metal component in an acidic medium as a so-called passivating conversion coating owing to the pickling attack on the treated metal surfaces. Both documents teach that dispersed water-insoluble inorganic compounds must additionally be contained to achieve the desired effect in terms of corrosion protection and paint adhesion, with WO 04/063414 explicitly requiring the presence of acid-stable, nano-dispersed compounds based on silica and, in contrast to U.S. Pat. No. 5,356,490, managing without the addition of organic polymers.

DE 1933013 also discloses phosphate-free treatment baths having a pH greater than 3.5, which, in addition to complex fluorides of boron, titanium or zirconium in quantities of 0.1 to 15 g/l, based on the metals, additionally contain 0.5 to 30 g/l oxidizing agent, particularly sodium m-nitrobenzenesulfonate. According to the teaching of DE 1933013, the oxidizing agent sodium m-nitrobenzenesulfonate is assigned the function of varying the treatment period of the metal surfaces to a particularly great extent.

In contrast, WO 03/002781 discloses pretreatment solutions which, besides phosphoric acid, also contain fluoro complexes of zirconium and/or titanium and a homo- or copolymer of vinylpyrrolidone. Such a pretreatment solution yields amorphous mixed organic/inorganic passivations with a low coating weight, which can be provided with an electrophoretic paint.

DE 2715292 discloses treatment baths for the chromium-free pretreatment of aluminum cans, which contain at least 10 ppm titanium and/or zirconium, between 10 and 1000 ppm phosphate and a quantity of fluoride sufficient to form complex fluorides of the titanium and/or zirconium present, but at least 13 ppm, and have pH values between 1.5 and 4.

Published patent application US 2007/0068602 discloses a passivating pretreatment solution which, in addition to fluoro complexes of zirconium and phosphate anions, also contains oxo anions of vanadium, the contents of which have to be within a specified ratio range to one another in order to achieve effective corrosion protection.

However, no teaching can be taken from the prior art on passivating pretreatment with compositions containing compounds of zirconium and/or titanium and phosphate regarding which specific compositions of such pretreatment solutions guarantee optimum corrosion protection with optimum electrophoretic paintability of the amorphous passivation layers. For original equipment manufacturers in particular, comparatively low paint consumption with good paint throwing power and equal corrosion resistance of the coated metal component are economically important.

SUMMARY OF THE INVENTION

It is an object of the invention to provide a method for the corrosion-protective pretreatment of metal components, which at least partially comprise metal surfaces made of iron, wherein the component is brought into contact with a chromium-free aqueous treatment solution containing (i) no less than 50 ppm and no more than 1000 ppm zirconium and/or titanium in the form of their fluoro complexes, and (ii) no less than 10 ppm and no more than 1000 ppm phosphate ions, the molar ratio of zirconium and/or titanium to phosphate ions being no greater than 10:1 and no less than 1:10, at a pH of no less than 3.5 and no greater than 6.0. In an embodiment of the invention, the molar ratio of zirconium and/or titanium to phosphate ions may be no less than 1:1. In an embodiment of the invention, the treatment solution may contain as accelerator (iii) nitrobenzenesulfonic acid with a content of no less than 20 ppm, preferably no less than 50 ppm and no more than 500 ppm, preferably no more than 300 ppm. In certain embodiments of the invention, the treatment solution may contain as component (i) preferably at least 150 ppm, particularly preferably at least 200 ppm, but preferably no more than 350 ppm, particularly preferably no more than 300 ppm zirconium in the form of a fluoro complex. In certain embodiments of the invention, the treatment solution may contain preferably at least 30 ppm, particularly preferably at least 60 ppm, but preferably no more than 180 ppm, particularly preferably no more than 120 ppm phosphate ions. In certain embodiments of the invention, the treatment solution additionally may contain nanoparticulate inorganic compounds of the elements silicon, aluminum, zinc, titanium, zirconium, iron, calcium and/or magnesium, the content of these compounds in the treatment solution being at least 10 ppm, based on the element, but not exceeding 200 ppm. In certain embodiments of the invention, the treatment solution additionally may contain chelating substances selected from α-hydroxycarboxylic acids, preferably selected from polyhydroxy acids with no more than 8 carbon atoms and particularly preferably gluconic acid. In certain embodiments of the invention, the content of chelating substances selected from α-hydroxycarboxylic acids in the treatment solution is at least 0.01 wt.%, preferably at least 0.05 wt. %, but no more than 2 wt. %, preferably no more than 1 wt. %. In certain embodiments of the invention, the treatment solution additionally may contain at least one surface-active substance.

It is also an object of the invention to provide a method for the corrosion-protective coating of non-closed metal hollow bodies, which at least partially comprise metal surfaces made of iron, wherein the hollow body is first (A) pretreated in accordance with the method according to one or more of the preceding claims and then (B) electrophoretically painted with or without an intermediate rinse step. In an embodiment of the invention, the ratio of internal shell surface of the non-closed hollow body to the opening surface thereof is no less than 5. In certain embodiments of the invention, after the pretreatment (A) and before the process step (B) of electrophoretic painting, no drying of the metal hollow body takes place. In certain embodiments of the invention, the ratio of the film thickness of the electrophoretic paint on the external shell surface of a hollow body coated according to process steps (A) and (B) to the film thickness of the electrophoretic paint after identical, but stand-alone, electrophoretic painting according to process step (B) on the identical external shell surface of an identical untreated, but cleaned and degreased, hollow body is no greater than 0.95, preferably no greater than 0.9 and particularly preferably no greater than 0.8.

It is a further object of the invention to provide metal articles coated according to the methods of the invention. In an embodiment of the invention, a non-closed metal hollow body is provided, which at least partially comprises metal surfaces made of iron, wherein it has been coated in accordance with a method of the invention.

DETAILED DESCRIPTION OF THE INVENTION

Figure 1:
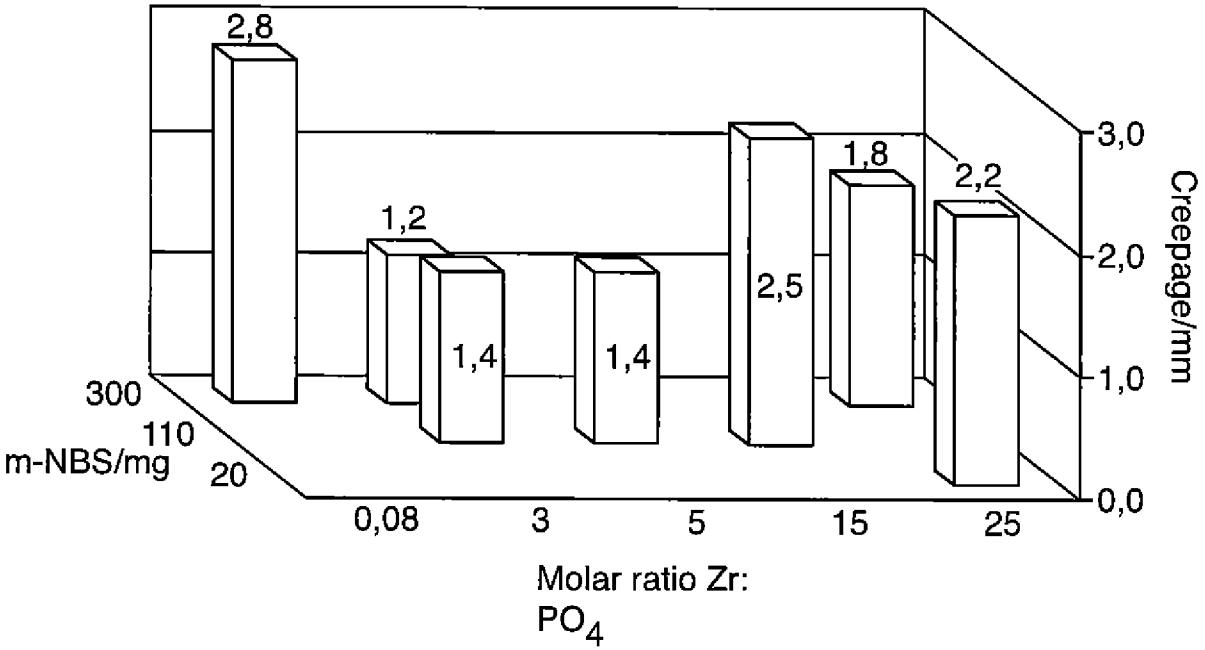
FIG. 1 shows a histograph of corrosion resistance (creepage/mm) as a function of the relative concentrations of zirconium (molar ratio $Zr:PO_4$), phosphate (molar ratio $Zr:PO_4$) and sodium m-nitrobenzenesulfonate (m-NBS/mg) of the Examples.

An object of the present invention accordingly consists in providing a conversion treatment of metal components consisting at least partially of iron, which provides at least comparable or improved results in terms of corrosion protection and electrophoretic paint consumption compared with the non-film-forming treatment methods known in the prior art, but without having to resort to the costly and energy-intensive process steps of film-forming phosphating. This alternative method should on the one hand provide a corrosion-protected metal surface, in particular an iron surface, in the fewest possible easily monitored process steps, and on the other hand it should be possible to carry out the method with the best possible conservation of resources, avoiding residues that are difficult to process, e.g. phosphate sludge. In addition, this alternative method should ensure the subsequent electrophoretic painting of the treated metal component, preferably in the form of a non-closed hollow body, aiming in principle for the lowest possible paint consumption with optimum paint throwing power.

This object is first achieved by a method for corrosion-protective pretreatment, wherein the component to be treated, which at least partially comprises metal surfaces made of iron, is brought into contact with a chromium-free aqueous treatment solution containing (i) no less than 50 ppm and no more than 1000 ppm zirconium and/or titanium in the form of their fluoro complexes, and (ii) no less than 10 ppm and no more than 1000 ppm phosphate ions, the molar ratio of zirconium and/or titanium to phosphate ions being no greater than 10:1 and no less than 1:10, at a pH of no less than 3.5 and no greater than 6.0.

The metal component here preferably consists completely of iron and/or an iron alloy with a content of more than 50 at.-% iron or of surfaces in which the proportion of iron is greater than 50 at.-%.

The treatment solution needs no additions of chromium compounds and is therefore chromium-free for ecological reasons and to guarantee a high level of industrial safety. However, it cannot be ruled out that ions of chromium might pass into the pretreatment solution in a low concentration from the container material or the surfaces to be treated, such as e.g. steel alloys. In practice, however, the concentration of chromium in the ready-to-use treatment solution is expected to be no higher than about 10 ppm, preferably no higher than 1 ppm.

The pH of the treatment solution can be adjusted at will within the given range by adding dilute nitric acid or ammoniacal solution. However, the pH of the treatment solution is particularly preferably below 5.5, in particular below 5.0.

By means of the molar ratio of zirconium and/or titanium to phosphate present in the treatment solution, the performance of the pretreatment can be adjusted in terms of corrosion resistance of the treated components and throwing power properties during subsequent electrophoretic painting. Surprisingly, it is shown that both too high ratios of zirconium and/or titanium to phosphate present in the treatment solution and too low relative zirconium and/or titanium contents have a marked negative impact on the throwing power properties. An optimum result, i.e. maximum throwing power during paint deposition, is achieved in particular when the molar ratio of zirconium and/or titanium to phosphate ions is adjusted to no less than 1:1. If the ratio is increased in favor of zirconium and/or titanium to values greater than 10:1, a zirconium- and/or titanium-based phosphate passivation can apparently no longer be completed effectively since the throwing power during subsequent paint deposition decreases significantly. The same also applies to the corrosion-protective properties of the pretreatment, which are particularly pronounced in the preferred ranges stated for the molar ratios of zirconium and/or titanium to phosphate ions.

The use of zirconium compounds in the different embodiments of the present invention yields technically better results than the use of titanium compounds, and is therefore preferred. For example, complex fluoro acids or salts thereof can be used.

In the method according to the invention, moreover, those treatment solutions are preferred which contain as component (i) at least 150 ppm, preferably at least 200 ppm, but no more than 350 ppm, preferably no more than 300 ppm zirconium in the form of a fluoro complex.

The phosphate content according to the invention of the treatment solution is extremely low compared with zinc or iron phosphating baths described in the prior art. Even a small concentration of phosphate ions of at least 10 ppm leads, in conjunction with the fluoro complexes of zirconium and/or titanium, to the formation of a thin amorphous zirconium and/or titanium phosphate layer and thus to the desired passivation of the metal surface, in particular the iron surface. Thus, homogeneous passivation already takes place at phosphate contents of preferably 30 ppm, particularly preferably at least 60 ppm. However, for reasons of process economy and to avoid phosphate sludge in the treatment bath, the phosphate content should not exceed 1000 ppm and should preferably be no more than 180 ppm, particularly preferably no more than 120 ppm phosphate ions.

Surprisingly, it is shown that accelerators known from zinc and iron phosphating favor the formation of a homogeneous passivation. These accelerators are represented by oxidizing agents, which take on the role of a "hydrogen trap" in the phosphating in that they directly oxidize the hydrogen forming as a result of the acid attack on the metal surface, and are themselves reduced in the process. The prevention of massive hydrogen generation on the material surface facilitates the formation of the crystalline phosphate layer with a film thickness of several micrometers during film-forming phosphating. The same applies to the presence of the accelerators in non-film-forming iron phosphating, in which layer thicknesses of not substantially more than one micrometer are produced. The accelerators known in the prior art are apparently also able to support the homogeneous formation of an amorphous passive layer comprising only a few nanometers based on zirconium and/or titanium phosphate. However, the activity of the accelerators in the treatment bath should be set at a substantially lower level than is the case for example in zinc phosphating, so that typical oxidizing agents should be used in contents of no more than 1000 ppm, but at least a content of 10 ppm must be present in the treatment solution in order to favor the zirconium and/or titanium-based passivation of the ferrous metal surface. Typical representatives of the oxidizing agents are chlorate ions, nitrite ions, nitroguanidine, N-methylmorpholine-N-oxide, m-nitrobenzoate ions, p-nitrophenol, m-nitrobenzenesulfonate ions, hydrogen peroxide in free or bound form, hydroxylamine in free or bound form, reducing sugars. Particularly with m-nitrobenzenesulfonate as accelerator, clearly improved passivation properties of the treatment solution are achieved at contents of no less than 20 ppm, preferably no less than 50 ppm and no more than 500 ppm, preferably no more than 300 ppm.

A further improvement in the passive layer properties and the adhesion to subsequently applied paint films results from the addition of particulate, inorganic, water-insoluble compounds of the elements silicon, aluminum, zinc, titanium, zirconium, iron, calcium and/or magnesium, in which case the content of these compounds in the treatment solution, based on the element, is at least 10 ppm but should not exceed 200 ppm in order not to destabilize the treatment solution by agglomeration and sedimentation processes of the particulate components. The oxidic compounds of the above elements are preferably used in nanoparticulate form.

The German patent application DE 100 05 113 is based on the finding that homo- or copolymers of vinylpyrrolidone exhibit an excellent corrosion protection action. The chromium-free treatment solution can therefore additionally contain preferably at least 50 ppm, but particularly preferably 200 ppm, but no more than 1000 ppm homo- or copolymers of vinylpyrrolidone in the method according to the invention.

Another feature of the present invention is that the method can preferably be carried out without the addition of organic polymers other than those represented by polymers based on homo- or copolymers of vinylpyrrolidone. Thus, polymers with hydroxyl and/or carboxyl functionalities are often added in considerable quantities (>1 g/l) to passivation baths to be incorporated in the inorganic passive layer where they act as binders to subsequently applied organic coatings. However, the addition of other polymers increases process costs considerably since, as a function of the "drag over" of the polymeric components from the pretreatment solution into the dip coating bath, the stability of the dip coating bath or the quality of the paint coating itself can be negatively affected. Preferably, therefore, the quantity of polymers which are not homo- or copolymers of vinylpyrrolidone in a treatment solution of the method according to the invention is no greater than 1 ppm.

Since any addition of polymer to the treatment solution in a method with subsequent electrophoretic painting therefore requires at least one intensive rinse step immediately after the pretreatment according to the invention, to reduce the rinse duration and the quantity of rinse water the method according to the invention should be adjusted in terms of the molar ratios of zirconium and/or titanium to phosphate ions such that a polymer addition can be completely omitted. The present invention therefore also comprises those methods in which the molar ratio of zirconium and/or titanium to phosphate ions is no less than 1:1 and the quantity of organic polymers in the treatment solution is no greater than 1 ppm.

Moreover, the method according to the invention needs no further inorganic additives selected from oxo anions of vanadium, tungsten and/or molybdenum to produce an adequate passivation of the metal, in particular iron, surface. In a particular embodiment, the treatment solution therefore explicitly contains no oxo anions of the type mentioned above, so by definition the content of these compounds is in particular no greater than 1 ppm.

In the treatment of special metal surfaces, particularly special iron alloys, small quantities of these oxo anions, particularly vanadates and molybdates, may be present in the treatment solution in the method according to the invention as an additional component, to remedy defects in the zirconium- and/or titanium-based phosphate layer during passivation. For reasons of process economy, however, the proportion of these compounds in the treatment solution of the method according to the invention, based on the particular element, is preferably less than 50 ppm, particularly preferably less than 10 ppm.

In the method according to the invention, the treatment solution can additionally contain chelating substances. Surprisingly, it is shown that, through the presence of chelating substances, particularly those based on α-hydroxycarboxylic acids, the pickling rate in the treatment bath is stabilized during prolonged operation of a bath so that, largely independently of the content of metal ions that pass into the bath as a result of the pickling of the metal surface, consistent coatings of the zirconium- and/or titanium-based phosphate layer result. Moreover, by adding the chelating substances, the formation of sludge consisting of sparingly soluble metal hydroxides can be significantly minimized. The chelating substances as an addition to the treatment solution in the method according to the invention are preferably selected from α-hydroxycarboxylic acids, particularly preferably selected from polyhydroxy acids with no more than 8 carbon atoms, with gluconic acid being particularly preferred. The content of chelating substances in the treatment solution of the method according to the invention is preferably at least 0.01 wt. %, particularly preferably at least 0.05 wt. %, but preferably no more than 2 wt. %, particularly preferably no more than 1 wt. %.

The metal component to be treated in the method according to the invention is optionally previously freed from surface impurities, particularly from lubricating and/or corrosion protection oils, in a cleaning step. If this cleaning is omitted, it is impossible to achieve a homogeneously formed passivation over the entire metal surface of the component in the method according to the invention. To save on the cleaning step prior to the pretreatment according to the invention, the acidic treatment solution of the method according to the invention can additionally contain at least one surface-active substance, so that the effective cleaning of the metal surfaces of the component and their passivation go together. The use of surface-active substances in passivating pretreatment solutions is not obvious and, to that extent, is surprising in the method according to the invention. Thus, for example, according to DE 1933013 (Bonderite NT®) no adequate passivation of the metal surface occurs in the presence of nonionic surfactants in phosphate-free treatment baths. In principle, all common surfactants, preferably nonionic surfactants, which are stable in the treatment solution of the method according to the invention and have a low critical micellization concentration below 10 mol/l, preferably below $10^{-4}$ mol/l, can be used as surface-active substances.

The method for passivating pretreatment according to the invention is preferably carried out at bath temperatures of the treatment solution of no more than 40° C. If the pretreatment solution additionally contains surface-active substances, the bath temperature for adequate cleaning of the metal surfaces of the component to be treated is preferably at least 30° C., higher bath temperatures than 80° C. on the one hand being unnecessary and on the other hand having a negative effect on the energy efficiency of the method.

In the treatment method according to the invention, the metal surfaces can be brought into contact with the pretreatment solution by either dipping or spraying.

In another aspect, the present invention also encompasses a method for the corrosion-protective coating of non-closed metal hollow bodies, which at least partially comprise metal surfaces made of iron, wherein the previously described method for corrosion-protective pretreatment according to the invention is followed by electrophoretic painting with or without an intermediate rinse step. Surprisingly, after electrophoretic painting the amorphous and extremely thin zirconium- and/or titanium-based phosphate passivation resulting after the pretreatment according to the invention displays acceptable corrosion resistance and paint adhesion compared with electrophoretically painted crystalline phosphate layers. On the other hand, the coating method according to the invention is at least equivalent, in terms of corrosion resistance and paint adhesion on iron or steel, to alternative methods which also form amorphous passive layers in a pretreatment step but based on oxidic zirconium-containing conversion coatings (Bonderite NT®). A decisive advantage of the pretreatment according to the invention over these alternative methods, however, is the lower paint consumption obtained during electrophoretic painting, with identical throwing power properties.

Preferably, those non-closed metal hollow bodies consisting at least partially of iron surfaces in which the ratio of internal shell surface of the non-closed hollow body to the opening surface thereof is no less than 5, which for example are therefore at least cube-shaped, should be coated according to the invention.

The throwing power, i.e. the deposition of the dipping paint on the surfaces of the component facing away from the counter-electrode or on the internal areas of the metal hollow body, which are almost free from field lines at the beginning of the deposition because of their Faraday shielding and therefore only become accessible for film formation via the build-up of resistance of the paint film being deposited, is determined decisively by the passivating pretreatment according to the invention and can therefore also be invoked as a characterizing feature of the pretreatment according to the invention or the coating according to the invention.

Thus, the process-specific limitation of the film thickness of the electrophoretic paint is decisive for the throwing power of the paint, since with the same amount of charge but a lower limited or maximum paint film thickness, better throwing power necessarily results.

In this sense, a specific film thickness limitation as the ratio of the film thickness of the electrophoretic paint on the external shell surface of a hollow body coated according to the invention to the film thickness of the electrophoretic paint after identical, but stand-alone, electrophoretic painting without previous pretreatment on the identical external shell surface of an identical untreated, but cleaned and degreased, hollow body can be given as a feature of the method according to the invention. According to the present invention, this should be no greater than 0.95, preferably no greater than 0.9 and particularly preferably no greater than 0.8.

The method according to the invention for coating a metal hollow body can be carried out such that, between the process steps of the pretreatment according to the invention and the process step of electrophoretic painting, a rinse step takes place, preferably with deionized water or tap water.

In another preferred embodiment of the coating method according to the invention, no drying of the metal hollow body takes place after the pretreatment according to the invention and before the process step of electrophoretic painting.

The present invention also provides the metal components and non-closed metal hollow bodies treated directly with the methods for pretreatment and coating according to the invention, the metal components and hollow bodies to be treated at least partially comprising metal surfaces made of iron.

Furthermore, the present invention encompasses the use of a metal component whose entire surface, which consists at least partially of metal surfaces made of iron, has been pretreated with the chromium-free aqueous treatment solution in accordance with the method according to the invention, for the application of further corrosion-protective coatings and/or organic lacquer systems.

The present invention also encompasses the use of a non-closed metal hollow body, whose entire surface, which consists at least partially of metal surfaces made of iron, has been pretreated first with the chromium-free aqueous treatment solution in accordance with the method according to the invention and then, with or without an intermediate rinse step, has been electrophoretically painted, for the production of radiators.

Exemplary Embodiments

Below, exemplary embodiments according to the invention and comparative examples for the pretreatment of steel plates (CRS: Cold Rolled Steel) are given, including their subsequent electrophoretic painting.

Comparative Example "Alkaline Cleaning"

CRS plates are treated in a dipping process for 5 min at 50° C. in an aqueous solution composed of 3 wt. % Ridoline 1562® and 0.3 wt. % Ridosol 1270® while stirring the cleaning solution.

Comparative Example "Bonderite NT-1®"

CRS plates are first cleaned in a dipping process according to the comparative example "alkaline cleaning", after which the cleaned plate is rinsed for 1 min under running deionized water (k<1 $\mu Scm^{-1}$). This is followed by treatment with Bonderite NT-1® (Henkel KGaA), a zirconium-containing but phosphate-free aqueous solution, in a dipping process for 1 min at 20° C. The plate pretreated in this way is then rinsed for 1 min under running deionized water (k<1 $\mu Scm^{-1}$).

Comparative Example "Zn-Phosphated"

CRS plates are first cleaned in a dipping process according to the comparative example "alkaline cleaning", after which the cleaned plate is rinsed for 1 min under running deionized water (k<1 $\mu Scm^{-1}$). This is followed by treatment with the commercial product Granodine 958® (Henkel KGaA) in a dipping process in accordance with the instructions. This treatment includes an activation step before the actual phosphating. The plate pretreated in this way is then rinsed for 1 min under running deionized water (κ<1 $\mu Scm^{-1}$).

Example According to the Invention "Zr-Phosphated"

CRS plates are first cleaned in a dipping process according to the comparative example "alkaline cleaning", after which the cleaned plate is rinsed for 1 min under running deionized water (k<1 $\mu Scm^{-1}$). This is followed by treatment by a spray method with an aqueous solution according to the invention composed of 300 ppm Zr as $H_2ZrF_6$,
100 ppm $PO_4$ as $H_3PO_4$,
100 ppm sodium m-nitrobenzenesulfonate (m-NBS) and
3000 ppm Ridosol 2000® (cleaner from Henkel KGaA)

for 2 min at 50° C., the pH being adjusted with ammoniacal solution to pH 4.5. The plate pretreated in this way is then rinsed for 1 min under running deionized water (k<1 $\mu Scm^{-1}$).

All the pretreated plates are then coated with a Cathogard 500 cathodic dipping paint from BASF and baked at 180° C. for 30 min.

The average paint film thickness is determined using the PosiTector 6000 film thickness measuring device (DeFelsko Ltd., Canada) by multiple measurements at different points on the side of the plate facing the anode. To determine the paint film thickness of the "Zn-phosphated" steel plate, the film thickness of the zinc phosphate layer is first determined using the PosiTector 6000 by multiple measurements before electrophoretic painting and subtracted from the film thickness determined after painting.

It can be seen from Table 1 that the pretreatment according to the invention possesses the lowest film thickness compared with the "non-film-forming" pretreatments with an identical electrophoretic painting period. Only the CRS plate with film-forming phosphating has an even lower paint film thickness after electrophoretic painting.

These experimental data make it clear that, by means of the pretreatment according to the invention, lower paint consumption and thus automatically also improved throwing power are achieved compared with the non-film-forming passivation method from the prior art.

TABLE 1

Film thickness of the electrophoretic paint and charge yield of the electrophoretic painting as a function of the type of pretreatment

| | Pretreatment | | | | | | | | | | | | | | | |
|---|---|---|---|---|---|---|---|---|---|---|---|---|---|---|---|---|
| | Alkaline cleaning | | | | Zr-phosphated | | | | Zn-phosphated | | | | Bonderite NT-1 ® | | | |
| | Individual sheets (CRS) | | | | | | | | | | | | | | | |
| | 1 | 2 | 3 | 4 | 1 | 2 | 3 | 4 | 1 | 2 | 3 | 4 | 1 | 2 | 3 | 4 |
| [1]Amount of charge/As | 102 | 102 | 102 | 102 | 91 | 91 | 90 | 90 | 86 | 86 | 85 | 85 | 95 | 95 | 95 | 95 |
| Average amount of charge/As | 102 | | | | 90.5 | | | | 85.5 | | | | 95 | | | |

TABLE 1-continued

Film thickness of the electrophoretic paint and charge yield of the electrophoretic painting as a function of the type of pretreatment

| | Pretreatment | | | | | | | | | | | | | | | |
|---|---|---|---|---|---|---|---|---|---|---|---|---|---|---|---|---|
| | Alkaline cleaning | | | | Zr-phosphated | | | | Zn-phosphated | | | | Bonderite NT-1 ® | | | |
| | Individual sheets (CRS) | | | | | | | | | | | | | | | |
| | 1 | 2 | 3 | 4 | 1 | 2 | 3 | 4 | 1 | 2 | 3 | 4 | 1 | 2 | 3 | 4 |
| [2]Film thickness/μm | 29.7 | 29.4 | 29.0 | 29.5 | 26.2 | 26.8 | 26.1 | 25.7 | 24.6 | 25.3 | 25.0 | 24.7 | 27.8 | 26.9 | 28.3 | 26.6 |
| Average film thickness/μm | 29.4 | | | | 26.2 | | | | 24.9 | | | | 27.4 | | | |
| Average charge yield/μm(As)$^{-1}$ | 0.288 | | | | 0.290 | | | | 0.291 | | | | 0.288 | | | |

[1]Amount of charge after an electrophoretic painting period of 2 min with an applied direct-current voltage of 240 V

[2]Determination of film thickness of electrophoretic paint on Zn-phosphated sheet from the difference between the film thicknesses measured after pretreatment and after electrophoretic painting The corrosion resistance of the plates pretreated in accordance with a formulation according to the preceding Example ("Zr-phosphated"), but with varying proportions of zirconium, phosphate and sodium m-nitrobenzenesulfonate, and electrophoretically painted according to the preceding Examples is reflected in FIG. 1. The rust creepage at scribe measured after aging the CRS plates coated in this way over a period of 504 h according to a salt-spray test (DIN 50021 SS) proves that, for those pretreatment solutions for which there is a molar ratio of zirconium to phosphate of 1:10 to 10:1, optimum corrosion resistance is achieved. The creepage values are thus comparable to, and even better than, those obtained for rust creepage after iron phosphating after 504 h, which are typically 1.5 mm, and insignificantly higher than after pretreatment with Bonderite NT-1®, which gives creepage values of 0.9 mm.

Figure 2:
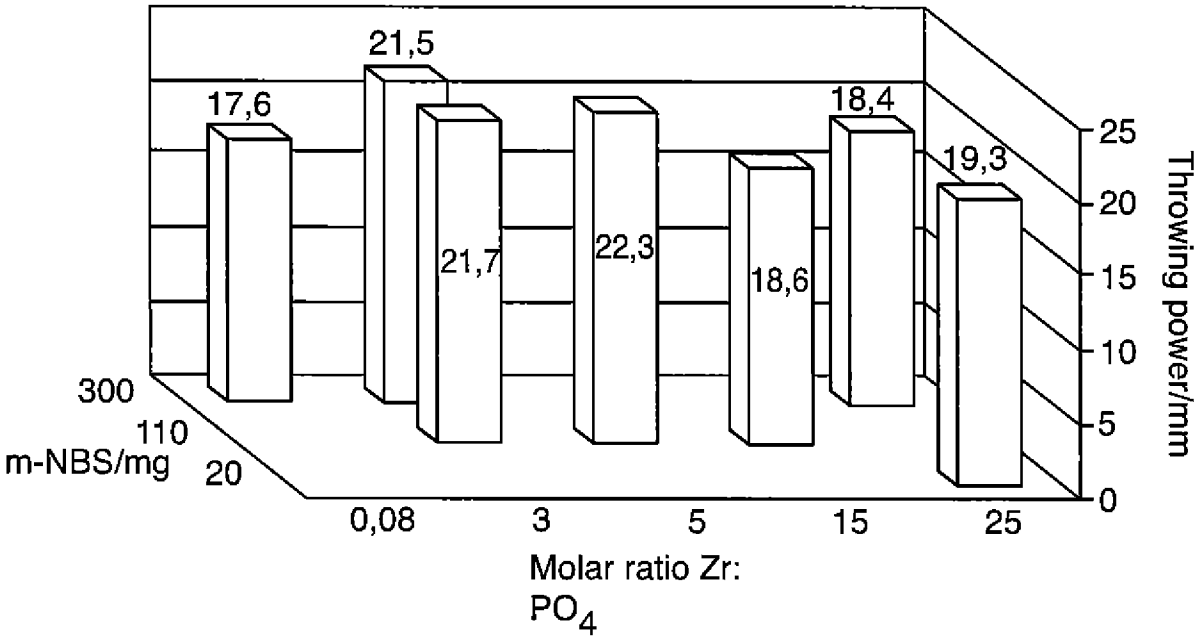
FIG. 2 shows a histograph of the effect of the relative concentrations of zirconium (molar ratio $Zr:PO_4$), phosphate (molar ratio $Zr:PO_4$) and sodium m-nitrobenzenesulfonate (m-NBS/mg) on throwing power of subsequently applied electrophoretic paint from the Examples.

In a similar way it can be established that the throwing power properties are also optimum for CRS plates pretreated with compositions with the corresponding molar ratios according to the invention (FIG. 2). The throwing power is measured multiple times at various points on the side of the plate facing away from the anode, and averaged.

What is claimed is:

1. A method for corrosion-protective pretreatment of metal components, comprising:

contacting a metal component at least partially comprised of metal surfaces made of iron, with a chromium-free aqueous treatment solution comprising:

(i) no less than 50 ppm and no more than 1000 ppm zirconium and/or titanium in the form of their fluoro complexes, and (ii) no less than 10 ppm and no more than 1000 ppm phosphate ions, (iii) a non-zero amount less than 50 ppm of oxo anions of vanadium, tungsten and/or molybdenum; and said treatment solution having a pH of no less than 3.5 and no greater than 6.0 and a molar ratio of zirconium and/or titanium to phosphate ions in a range no greater than 10:1 and no less than 1:10; and wherein the method is carried out without addition of organic polymers other than organic polymers based on homo- or copolymers of vinylpyrrolidone.

2. The method according to claim 1, wherein the molar ratio of zirconium and/or titanium to phosphate ions is no less than 1:1.

3. The method according to claim 1, wherein the treatment solution further comprises as accelerator (iii) nitrobenzenesulfonic acid present in an amount of no less than 20 ppm and no more than 500 ppm.

4. The method according to claim 1, wherein said zirconium and/or titanium in the form of their fluoro complexes (i) is present in an amount ranging from at least 150 ppm to no more than 350 ppm zirconium in the form of a fluoro complex.

5. The method according to claim 4, wherein said zirconium and/or titanium in the form of their fluoro complexes (i) is present in an amount ranging from at least 200 ppm to no more than 300 ppm zirconium in the form of a fluoro complex.

6. The method according to claim 1, wherein said phosphate ions (ii) are present in an amount ranging from at least 30 ppm to no more than 180 ppm.

7. The method according to claim 1, wherein said phosphate ions (ii) are present in an amount ranging from at least 60 ppm to no more than 120 ppm.

8. The method according to claim 1, wherein the treatment solution additionally comprises at least one nanoparticulate inorganic compound of one or more elements selected from the group consisting of silicon, aluminum, zinc, titanium, zirconium, iron, calcium and magnesium, said at least one nanoparticulate inorganic compound being present in an amount of at least 10 ppm, based on the elements, but not exceeding 200 ppm.

9. The method according to claim 8, wherein the treatment solution additionally comprises:

no less than 50 ppm and no more than 300 ppm accelerator, at least 0.01 wt. % but no more than 2 wt. % of at least one chelating substance selected from α-hydroxycarboxylic acids, and at least one surface-active substance.

10. The method according to claim 1, wherein the treatment solution additionally comprises at least one chelating substance selected from α-hydroxycarboxylic acids present in an amount of at least 0.01 wt. % but no more than 2 wt. %.

11. The method according to claim 10, wherein the at least one chelating substance selected from α-hydroxycarboxylic acids is a polyhydroxy acid with no more than 8 carbon atoms present in the treatment solution in an amount of at least 0.05 wt. % but no more than 1 wt. %.

12. The method according to claim 1, wherein the treatment solution additionally comprises at least one surface-active substance.

13. A method for corrosion-protective coating of non-closed hollow metal bodies, which at least partially comprise metal surfaces made of iron, comprising steps of:

(A) first pretreating said non-closed hollow metal bodies according to the method of claim 1, and thereafter (B) electrophoretically painting said non-closed hollow metal bodies thereby forming a film thickness of electrophoretic paint on the non-closed hollow metal bodies, with or without an intermediate rinse step.

14. The method according to claim 13, wherein the non-closed hollow metal bodies have an internal shell surface and an opening surface, and a ratio of the internal shell surface to the opening surface is no less than 5.

15. The method according to claim 13, wherein after the pretreating step (A) and before the painting step (B), no drying of the metal hollow body takes place.

16. The method according to claim 13, wherein the film thickness of the electrophoretic paint on an external shell surface of the non-closed hollow metal bodies coated according to process steps (A) and (B) has a ratio to a film thickness of electrophoretic paint after identical, electrophoretic painting according to step (B), without prior step (A), on an identical external shell surface of an identical un-pretreated, but cleaned and degreased, hollow body is no greater than 0.95.

17. A method of making a radiator comprising using the non-closed hollow metal body according to claim 13.

18. The method according to claim 1, wherein the organic polymers based on homo- or copolymers of vinylpyrrolidone are present in an amount of 50-1000 ppm.

19. A method for corrosion-protective pretreatment of metal components, comprising:

contacting a metal component at least partially comprised of metal surfaces made of iron, with a chromium-free aqueous treatment solution comprising:

(i) no less than 50 ppm and no more than 1000 ppm zirconium and/or titanium in the form of their fluoro complexes, and (ii) no less than 10 ppm and no more than 1000 ppm phosphate ions, (iii) zero up to less than 50 ppm of oxo anions of vanadium, tungsten and/or molybdenum;

wherein the treatment solution has a pH of no less than 3.5 and no greater than 6.0 and a molar ratio of zirconium and/or titanium to phosphate ions in a range no greater than 10:1 and no less than 1:1, and a quantity of organic polymers in the treatment solution is no greater than 1 ppm.

* * * * *